US007717133B2

(12) United States Patent
Pinette et al.

(10) Patent No.: US 7,717,133 B2
(45) Date of Patent: May 18, 2010

(54) SPOUT TIP ATTACHMENT

(75) Inventors: Thomas C. Pinette, Indianapolis, IN (US); Kurt J. Thomas, Indianapolis, IN (US); Derek A. Brown, Lizton, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 670 days.

(21) Appl. No.: 11/700,586

(22) Filed: Jan. 31, 2007

(65) Prior Publication Data

US 2008/0178954 A1 Jul. 31, 2008

(51) Int. Cl.
*F16K 21/00* (2006.01)

(52) U.S. Cl. ..... 137/801

(58) Field of Classification Search ..... 137/801; 4/675–678; 239/428.5, 553.3, 575
See application file for complete search history.

(56) References Cited

U.S. PATENT DOCUMENTS

| | | | | |
|---|---|---|---|---|
| 2,200,091 | A | | 5/1940 | Kovach |
| 2,219,471 | A | | 10/1940 | Davis |
| 2,546,327 | A | | 3/1951 | Young |
| 2,548,933 | A | | 4/1951 | Barnett |
| 2,781,786 | A | | 2/1957 | Young |
| 2,884,007 | A | | 4/1959 | Green |
| 3,229,710 | A | | 1/1966 | Keller, III |
| 3,422,849 | A | | 1/1969 | Manoogian |
| 3,505,098 | A | | 4/1970 | Miller et al. |
| 3,520,325 | A | | 7/1970 | Stuart |
| 3,580,289 | A | | 5/1971 | James et al. |
| 3,590,876 | A | | 7/1971 | Young |
| 3,600,723 | A | | 8/1971 | Mongerson et al. |
| 3,757,824 | A | | 9/1973 | Parkhurst et al. |
| 3,796,380 | A | | 3/1974 | Johnson et al. |
| 3,807,453 | A | | 4/1974 | Dom et al. |
| 3,854,493 | A | | 12/1974 | Farrell |
| 3,965,936 | A | | 6/1976 | Lyon |
| 3,989,787 | A | | 11/1976 | Scott, Jr. et al. |
| 3,998,240 | A | | 12/1976 | Liautaud |
| 4,000,857 | A | * | 1/1977 | Moen ..... 239/428.5 |
| 4,026,328 | A | | 5/1977 | Nelson |
| 4,076,279 | A | | 2/1978 | Klotz et al. |

(Continued)

FOREIGN PATENT DOCUMENTS

DE 10133041 1/2003

(Continued)

OTHER PUBLICATIONS

Noveon, Inc.; Processing with TempRite® PEX Ensures Quality Piping, www.tempritepex.com/processingInstallation/processing.asp, at least as early as Jun. 7, 2005, 2 pgs.

(Continued)

*Primary Examiner*—John Rivell
*Assistant Examiner*—Craig M Schneider
(74) *Attorney, Agent, or Firm*—Baker & Daniels LLP

(57) ABSTRACT

A water delivery system is disclosed including a first component coupled to a fluid transport member, the first component including an interface, and a second component coupled to an aerator. The second component positioning the first component relative to the aerator. The aerator and the interface of the first component cooperate to form a water tight seal there between.

48 Claims, 5 Drawing Sheets

U.S. PATENT DOCUMENTS

| | | | |
|---|---|---|---|
| 4,103,709 | A | 8/1978 | Fischer |
| 4,130,136 | A | 12/1978 | Garnier et al. |
| 4,221,338 | A | 9/1980 | Shames et al. |
| 4,316,870 | A | 2/1982 | Rowley |
| 4,337,795 | A | 7/1982 | Argyris et al. |
| 4,356,574 | A | 11/1982 | Johnson |
| 4,357,957 | A | 11/1982 | Bisonaya et al. |
| 4,387,738 | A | 6/1983 | Bisonaya et al. |
| 4,415,389 | A | 11/1983 | Medford et al. |
| 4,446,084 | A | 5/1984 | Rowley |
| 4,453,567 | A | 6/1984 | MacDonald |
| 4,458,839 | A | 7/1984 | MacDonald |
| 4,484,600 | A | 11/1984 | Peterson et al. |
| 4,502,507 | A | 3/1985 | Hayman |
| 4,513,769 | A | 4/1985 | Purcell |
| 4,525,136 | A | 6/1985 | Rowley |
| 4,552,171 | A | 11/1985 | Farrell et al. |
| 4,577,835 | A | 3/1986 | Holycross et al. |
| 4,580,601 | A | 4/1986 | Schlotman et al. |
| 4,592,388 | A | 6/1986 | Wilcox |
| 4,607,659 | A | 8/1986 | Cole |
| 4,610,429 | A | 9/1986 | Arnold et al. |
| 4,626,005 | A | 12/1986 | Stifter |
| 4,635,673 | A | 1/1987 | Gerdes |
| 4,649,958 | A | 3/1987 | Purcell |
| 4,652,263 | A | 3/1987 | Herweck et al. |
| 4,664,423 | A | 5/1987 | Rowley |
| 4,667,987 | A | 5/1987 | Knebel |
| 4,687,025 | A | 8/1987 | Kahle et al. |
| 4,700,928 | A | 10/1987 | Marty |
| 4,708,172 | A | 11/1987 | Riis |
| 4,754,993 | A | 7/1988 | Kraynick |
| 4,760,871 | A | 8/1988 | Vijay |
| 4,762,143 | A | 8/1988 | Botnick |
| 4,773,348 | A | 9/1988 | Rowley |
| 4,783,303 | A | 11/1988 | Imgram |
| 4,803,033 | A | 2/1989 | Rowley |
| 4,838,304 | A | 6/1989 | Knapp |
| 4,853,164 | A | 8/1989 | Kiang et al. |
| 4,877,660 | A | 10/1989 | Overbergh et al. |
| 4,887,642 | A | 12/1989 | Bernat |
| 4,942,644 | A | 7/1990 | Rowley |
| 4,957,135 | A | 9/1990 | Knapp |
| 4,971,112 | A | 11/1990 | Knapp |
| 4,979,530 | A | 12/1990 | Breda |
| 5,001,008 | A | 3/1991 | Tokita et al. |
| 5,006,207 | A | 4/1991 | Peterman et al. |
| 5,027,851 | A | 7/1991 | Drees et al. |
| 5,053,097 | A | 10/1991 | Johansson et al. |
| 5,090,062 | A | 2/1992 | Hochstrasser |
| 5,095,554 | A | 3/1992 | Gloor |
| 5,100,565 | A | 3/1992 | Fujiwara et al. |
| 5,110,044 | A | 5/1992 | Bergmann |
| 5,127,814 | A | 7/1992 | Johnson et al. |
| 5,131,428 | A | 7/1992 | Bory |
| 5,148,837 | A | 9/1992 | Ågren et al. |
| 5,150,922 | A | 9/1992 | Nakashiba et al. |
| 5,219,185 | A | 6/1993 | Oddenino |
| 5,279,333 | A | 1/1994 | Lawrence |
| 5,366,253 | A | 11/1994 | Nakashiba et al. |
| 5,375,889 | A | 12/1994 | Nakashiba et al. |
| 5,397,102 | A | 3/1995 | Kingman |
| 5,417,242 | A | 5/1995 | Goncze |
| 5,493,873 | A | 2/1996 | Donselman et al. |
| 5,494,259 | A | 2/1996 | Peterson |
| 5,518,027 | A | 5/1996 | Saiki et al. |
| 5,527,503 | A | 6/1996 | Rowley |
| 5,553,935 | A | 9/1996 | Burnham et al. |
| 5,555,912 | A | 9/1996 | Saadi et al. |
| 5,558,128 | A | 9/1996 | Pawelzik et al. |
| 5,566,707 | A | 10/1996 | Ching et al. |
| 5,573,037 | A | 11/1996 | Cole et al. |
| 5,577,393 | A | 11/1996 | Donselman et al. |
| 5,579,808 | A | 12/1996 | Mikol et al. |
| 5,611,093 | A | 3/1997 | Barnum et al. |
| 5,615,709 | A | 4/1997 | Knapp |
| 5,622,210 | A | 4/1997 | Crisman et al. |
| 5,622,670 | A | 4/1997 | Rowley |
| 5,642,755 | A | 7/1997 | Mark et al. |
| 5,660,692 | A | 8/1997 | Nesburn et al. |
| 5,669,407 | A | 9/1997 | Bailey |
| 5,669,417 | A | 9/1997 | Lian-Jie |
| 5,669,595 | A | 9/1997 | Bytheway |
| 5,685,341 | A | 11/1997 | Chrysler et al. |
| 5,687,952 | A | 11/1997 | Arnold et al. |
| 5,695,094 | A | 12/1997 | Burnham et al. |
| 5,725,008 | A | 3/1998 | Johnson |
| 5,730,173 | A | 3/1998 | Sponheimer |
| 5,741,458 | A | 4/1998 | Rowley |
| 5,746,244 | A | 5/1998 | Woolley, Sr. et al. |
| 5,756,023 | A | 5/1998 | Stachowiak |
| 5,758,690 | A | 6/1998 | Humpert et al. |
| 5,775,587 | A | 7/1998 | Davis |
| 5,803,120 | A | 9/1998 | Bertoli |
| 5,813,435 | A | 9/1998 | Knapp |
| 5,833,279 | A | 11/1998 | Rowley |
| 5,850,855 | A | 12/1998 | Kerschbaumer et al. |
| 5,857,489 | A | 1/1999 | Chang |
| 5,861,200 | A | 1/1999 | Rowley |
| 5,865,473 | A | 2/1999 | Semchuck et al. |
| 5,875,809 | A | 3/1999 | Barrom |
| 5,893,387 | A | 4/1999 | Paterson et al. |
| 5,895,695 | A | 4/1999 | Rowley |
| 5,916,647 | A | 6/1999 | Weinstein |
| 5,924,451 | A | 7/1999 | Kuo |
| 5,927,333 | A | 7/1999 | Grassberger |
| 5,934,325 | A | 8/1999 | Brattoli et al. |
| 5,937,892 | A | 8/1999 | Meisner et al. |
| 5,944,225 | A | 8/1999 | Kawolics |
| 5,950,663 | A | 9/1999 | Bloomfield |
| 5,960,490 | A | 10/1999 | Pitch |
| 5,965,077 | A | 10/1999 | Rowley et al. |
| 5,975,143 | A | 11/1999 | Järvenkylä et al. |
| 5,979,489 | A | 11/1999 | Pitch |
| 6,013,382 | A | 1/2000 | Coltrinari et al. |
| 6,023,796 | A | 2/2000 | Pitch |
| 6,027,044 | A | 2/2000 | Hirata |
| 6,029,860 | A | 2/2000 | Donselman et al. |
| 6,029,948 | A | 2/2000 | Shafer |
| 6,053,214 | A | 4/2000 | Sjoberg et al. |
| 6,062,251 | A | 5/2000 | Pitch |
| 6,070,614 | A | 6/2000 | Holzheimer et al. |
| 6,070,916 | A | 6/2000 | Rowley |
| 6,073,972 | A | 6/2000 | Rivera |
| 6,079,447 | A | 6/2000 | Holzheimer et al. |
| 6,082,407 | A | 7/2000 | Paterson et al. |
| 6,082,780 | A | 7/2000 | Rowley et al. |
| 6,085,784 | A | 7/2000 | Bloom et al. |
| 6,116,884 | A | 9/2000 | Rowley |
| 6,123,232 | A | 9/2000 | Donselman et al. |
| 6,131,600 | A | 10/2000 | Chang |
| 6,138,296 | A | 10/2000 | Baker |
| 6,155,297 | A | 12/2000 | MacAusland et al. |
| 6,161,230 | A | 12/2000 | Pitsch |
| 6,170,098 | B1 | 1/2001 | Pitsch |
| 6,177,516 | B1 | 1/2001 | Hudak |
| 6,179,130 | B1 | 1/2001 | Nguyen et al. |
| 6,202,686 | B1 | 3/2001 | Pitsch et al. |
| 6,227,464 | B1 | 5/2001 | Allmendinger et al. |
| 6,238,575 | B1 | 5/2001 | Patil |
| 6,256,810 | B1 | 7/2001 | Baker |
| 6,270,125 | B1 | 8/2001 | Rowley et al. |
| 6,287,501 | B1 | 9/2001 | Rowley |
| 6,293,336 | B1 | 9/2001 | Emerick, Sr. et al. |

| | | | | |
|---|---|---|---|---|
| 6,296,017 | B2 | 10/2001 | Kimizuka | |
| 6,305,407 | B1 | 10/2001 | Selby | |
| 6,315,715 | B1 | 11/2001 | Taylor et al. | |
| 6,328,059 | B1 | 12/2001 | Testori et al. | |
| 6,334,466 | B1 | 1/2002 | Jani et al. | |
| 6,341,617 | B1 | 1/2002 | Wilson | |
| 6,349,733 | B1 | 2/2002 | Smith | |
| 6,378,790 | B1 | 4/2002 | Paterson et al. | |
| 6,378,912 | B1 * | 4/2002 | Condon et al. | 285/220 |
| 6,385,794 | B1 | 5/2002 | Miedzius et al. | |
| 6,464,266 | B1 | 10/2002 | O'Neill et al. | |
| 6,485,666 | B1 | 11/2002 | Rowley | |
| 6,517,720 | B1 | 2/2003 | Aldred et al. | |
| 6,557,907 | B2 | 5/2003 | Rowley | |
| 6,609,732 | B1 | 8/2003 | Souvatzidis et al. | |
| 6,635,334 | B1 | 10/2003 | Jackson et al. | |
| 6,732,543 | B2 | 5/2004 | Jenkins, Jr. et al. | |
| 6,770,376 | B2 | 8/2004 | Chen | |
| 6,770,384 | B2 | 8/2004 | Chen | |
| 6,783,160 | B2 | 8/2004 | Rowley | |
| 6,803,133 | B2 | 10/2004 | Chen | |
| 6,817,379 | B2 | 11/2004 | Perla | |
| 6,835,777 | B2 | 12/2004 | Botros | |
| 6,838,041 | B2 | 1/2005 | Rowley | |
| 6,848,719 | B2 | 2/2005 | Rowley | |
| 6,860,523 | B2 | 3/2005 | O'Neill et al. | |
| 6,860,524 | B1 | 3/2005 | Rowley | |
| 6,877,172 | B2 | 4/2005 | Malek et al. | |
| 6,894,115 | B2 | 5/2005 | Botros | |
| 6,902,210 | B1 | 6/2005 | Rowley | |
| 6,920,899 | B2 | 7/2005 | Haenlein et al. | |
| 6,959,736 | B2 | 11/2005 | Järvenkylä | |
| 6,962,168 | B2 | 11/2005 | McDaniel et al. | |
| 6,978,795 | B2 | 12/2005 | Perrin | |
| 7,118,138 | B1 | 10/2006 | Rowley et al. | |
| 7,225,828 | B2 | 6/2007 | Giagni et al. | |
| 7,415,991 | B2 * | 8/2008 | Meehan et al. | 137/801 |
| 2002/0100139 | A1 | 8/2002 | Rowley | |
| 2002/0167171 | A1 | 11/2002 | Becker et al. | |
| 2004/0007278 | A1 | 1/2004 | Williams | |
| 2004/0021120 | A1 | 2/2004 | Turnau, III et al. | |
| 2004/0060608 | A1 | 4/2004 | Angus | |
| 2004/0117906 | A1 | 6/2004 | Baker et al. | |
| 2004/0150132 | A1 | 8/2004 | Rowley | |
| 2004/0176503 | A1 | 9/2004 | Czayka et al. | |
| 2005/0005989 | A1 | 1/2005 | Roloff | |
| 2005/0194051 | A1 | 9/2005 | Pinette | |
| 2006/0108705 | A1 | 5/2006 | Rowley | |
| 2006/0118185 | A1 | 6/2006 | Nobili | |
| 2006/0124183 | A1 | 6/2006 | Kuo | |
| 2006/0130908 | A1 | 6/2006 | Marty et al. | |
| 2006/0170134 | A1 | 8/2006 | Rowley et al. | |
| 2006/0202142 | A1 | 9/2006 | Marty et al. | |
| 2007/0044852 | A1 | 3/2007 | Pinette | |
| 2007/0137714 | A1 | 6/2007 | Meehan et al. | |
| 2007/0137718 | A1 | 6/2007 | Rushlander et al. | |

FOREIGN PATENT DOCUMENTS

| | | |
|---|---|---|
| EP | 0 632 220 | 1/1995 |
| EP | 0 808 952 | 11/1997 |
| JP | 200132343 | 5/1990 |
| JP | 3094877 | 4/1991 |
| JP | 05-40364 | 6/1993 |
| JP | 2001-059246 | 3/2001 |
| WO | WO 91/05191 | 4/1991 |
| WO | WO 00/61831 | 10/2000 |
| WO | WO 02/25022 | 3/2002 |
| WO | WO 2005/108829 | 11/2005 |

OTHER PUBLICATIONS

SpecialChem S.A., Silane Crosslinking Agents Center, Crosslinking Mechanism, www.specialchem4polymers.com/tc/silane-crosslinking-agents/index.aspx?id=mechanism, at least as early as Jun. 7, 2005, 2 pgs.

PPI Plastics Pipe Institute, Crosslinked Polyethylene (PEX) Tubing, TN-17/2001, www.plasticpipe.org/pdf/pubs/notes/tn17-01.pdf, Jun. 2001, 7 pgs.

Dadex Polydex, 2005, 1 pg.

Dadex Polydex—PPR Pipe System for Hot and Cold Water Supply and Distribution, 2005, 2 pgs.

Dow, Plastic Pipes Europe, Middle East & Africa, Hot and Cold Water Pipes, 2007, 1 pg.

Dow, Plastic Pipes Europe, Middle East, & Africa, Dowlex PE-RT, 2007, 2 pgs.

Kerox, Standard Cartridges, 2005, 3 pgs.

Ticona Engineering Polymers, Engineering Polymers for Innovative Applications catalog, Mar. 2006, 16 pgs.

* cited by examiner

SPOUT TIP ATTACHMENT

RELATED APPLICATIONS

This application relates to co-pending U.S. patent application Ser. No. 11/700,801, filed Jan. 31, 2007, titled "OVERMOLD INTERFACE FOR FLUID CARRYING SYSTEM", the disclosure of which is expressly incorporated by reference herein.

BACKGROUND AND SUMMARY OF THE INVENTION

The present invention relates interfaces of fluid conduits and in particular to interfaces provided as apart of an overmold of a portion of a fluid conduit.

Water delivery devices, such as faucets, are known which include a valve which may be controlled to regulate the flow of water.

In an exemplary embodiment of the present disclosure, a water delivery system in fluid communication with at least one valve is provided. The water delivery system comprises a spout member having a discharge end, an aerator for positioning adjacent the discharge end of the spout member, a fluid transport member, a first component coupled to the fluid transport member, and a second component coupled to the aerator. The fluid transport member has a fluid conduit with a first end in fluid communication with the at least one valve and a second end positioned proximate the discharge end of the spout member. The first component includes a fluid conduit in fluid communication with the fluid conduit of the fluid transport member and including an interface. The second component positioning the first component relative to the aerator. The aerator and the interface of the first component cooperating to form a water tight seal there between.

In another exemplary embodiment of the present disclosure, a water delivery system in fluid communication with at least one valve is provided. The water delivery system comprises a body and a fluid transport member positioned within the body and adapted to be in fluid communication with the at least one valve. The fluid transport member has a first end through which water exits. The water delivery device further comprises a holder supported by the body and includes a fluid conduit having a first end and a second end. The first end of the fluid transport member is received in the first end of the holder. The first end of the fluid transport member is held within the fluid conduit of the holder by translating the holder to a first position in a first direction and the first end of the fluid transport member is removable from within the fluid conduit of the holder by translating the holder to a second position in a second direction.

In a further exemplary embodiment of the present disclosure, a water delivery system in fluid communication with at least one valve is provided. The water delivery system comprises a spout including a body having a base portion and a spout portion. The spout is made of a non-metallic material. The spout portion includes a channel extending from the base portion to a location proximate a discharge end of the spout portion. The water delivery system further comprises a fluid transport member having a fluid conduit with a first end in fluid communication with the at least one valve and a second end positioned proximate the discharge end of the spout portion of the body of the spout. A portion of the fluid transport member is received in the channel.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to the precise forms disclosed. Rather, the embodiments selected for description have been chosen to enable one skilled in the art to practice the invention. Although the disclosure is described in connection with water, it should be understood that additional types of fluids may be used.

Figure 1:
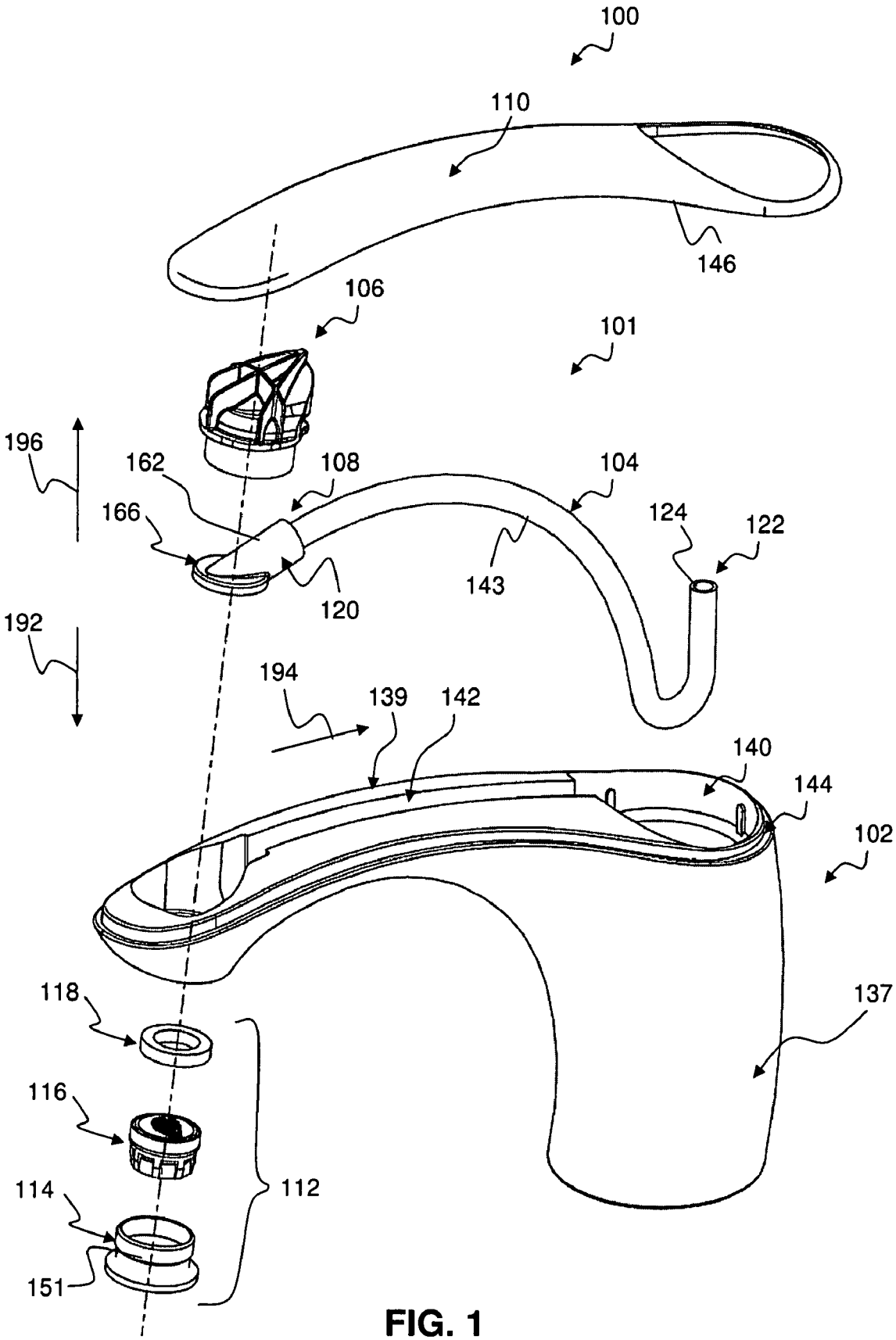
FIG. 1 is an exploded, perspective view of a spout assembly.
Figure 2:
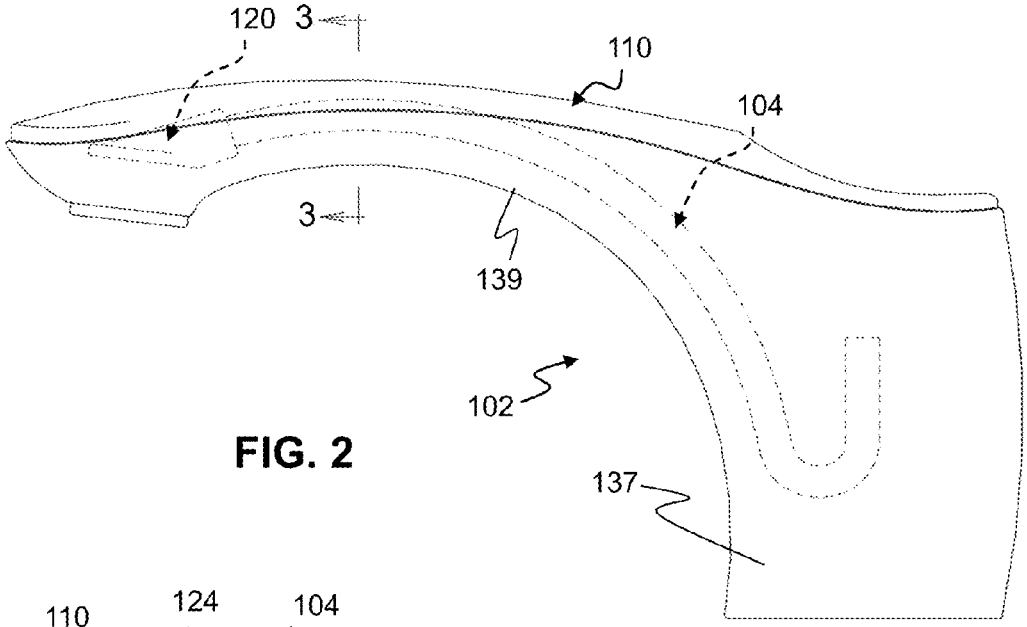
FIG. 2 is a side view of portion of the spout assembly of FIG. 1.

Referring to FIG. 1, an illustrative embodiment of a spout assembly 100 is shown. Spout assembly 100 is an exemplary water delivery system. Spout assembly 100 may be used with a faucet assembly having a faucet valve, such as the faucet assembly shown in U.S. patent application Ser. No. 11/700,634, filed Jan. 31, 2007, entitled "FAUCET INCLUDING A MOLDED WATERWAY ASSEMBLY", the disclosure of which is expressly incorporated by reference herein.

Figure 9:
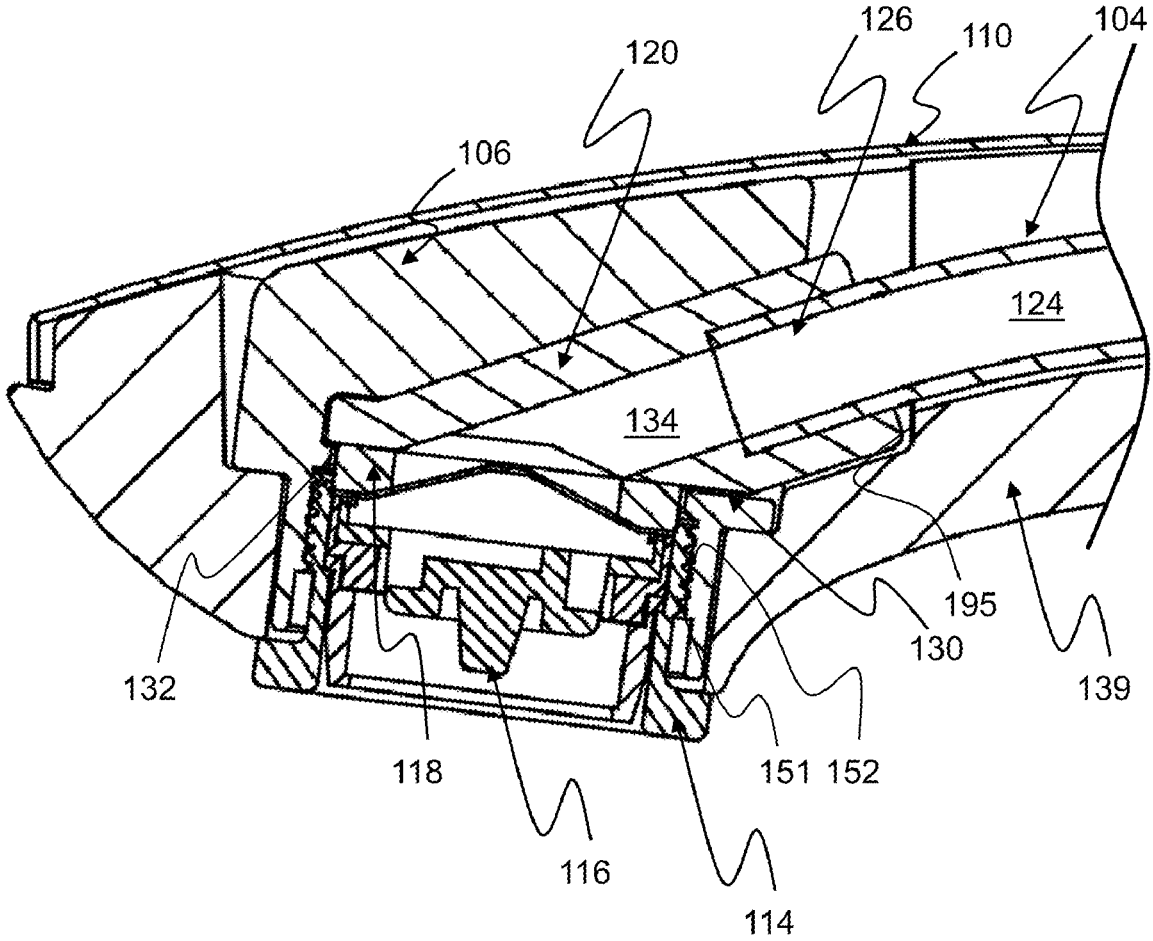
FIG. 9 is a sectional view of the assembly of FIG. 1.

Spout assembly 100 includes a spout body 102, a fluid carrying system 101, a holder 106 for holding an end portion 108 of fluid carrying system 101, a cover 110, and an aerator assembly 112. Aerator assembly 112 includes an aerator body 114 which is coupled to spout body 102, an aerator device 116, and a seal 118. Seal 118 creates a fluid type connection between the end portion 108 of fluid carrying system 101 and aerator device 116, as shown in FIG. 9. Aerator body 114 is coupled to holder 106. In the illustrated embodiment, aerator body 114 includes threads 151 which are threadably coupled with threads 152 on holder 106. Aerator assembly 112 is positioned adjacent a discharge end of spout body 102. Water is received from the faucet assembly and flows through fluid carrying system 101, exits overmold component 120, flows through aerator assembly 112, and is discharged from spout assembly 100.

In one embodiment, spout body 102 is made from a non-metallic material. Exemplary non-metallic materials include thermoplastic and thermoset materials, including polybutylene terephthalate (PBT). Further illustratively cross-linked materials may be utilized such as cross-linked polyethylene (PEX). Exemplary thermoset materials include polyesters, melamine, melamine urea, melamine phenolic, and phenolic. Additional details about exemplary PEX materials may be found in one or more of U.S. Pat. No. 5,895,695, U.S. Pat. No. 6,082,780, U.S. Pat. No. 6,287,501, and U.S. Pat. No. 6,902, 210, the disclosures of which are expressly incorporated by reference herein. In one embodiment, the spout body 102 is made from a metallic material.

Fluid carrying system 101 includes a fluid transport component 104 and an overmold component 120. Fluid transport component 104 may be made of a flexible material or a non-flexible material. Further, fluid transport component 104 may include a metallic material or a non-metallic material. In one embodiment, fluid transport component 104 is made from a polymeric material. In one embodiment, fluid transport component 104 is made from a cross-linked polyethylene (PEX) material. In one embodiment, fluid transport component 104 is made from a pre-formed PEX tubing. In one embodiment, fluid transport component 104 is made from a corrugated PEX tubing to increase flexibility. Additional details about PEX materials and methods for creating a fluid transport component 104 therefrom are found in one or more of U.S. Pat. No. 5,895,695, U.S. Pat. No. 6,082,780, U.S. Pat. No. 6,287,501, and U.S. Pat. No. 6,902,210, the disclosures of which are expressly incorporated by reference herein.

A first end 122 of fluid transport component 104 is coupled to a fluid supply (not shown). In one example, first end 122 is coupled to the faucet assembly including a valve disclosed in U.S. patent application Ser. No. 11/700,634, filed Jan. 31, 2007, entitled "FAUCET INCLUDING A MOLDED WATERWAY ASSEMBLY," the disclosure of which is expressly incorporated herein by reference.

Fluid provided by the faucet assembly is transported through a fluid conduit 124 of fluid transport component 104. A second end 126 of fluid transport component 104 is coupled to overmold component 120. Overmold component 120 provides an interface 130 including a sealing surface 132. Overmold component 120 includes a fluid conduit 134 which is in fluid communication with fluid conduit 124 of fluid transport component 104. Sealing surface 132, in the illustrated embodiment, is angled relative to fluid conduit 134. In the illustrated embodiment, sealing surface 132 is generally flat. In the illustrated embodiment, a terminal end of fluid conduit is provided inside an outer perimeter of sealing surface 132. Additional details concerning overmold component 120 are found in U.S. patent application Ser. No. 11/700,801, filed Jan. 31, 2007, entitled "OVERMOLD INTERFACE FOR FLUID CARRYING SYSTEM," the disclosure of which is expressly incorporated by reference herein.

As shown in FIG. 9, seal 118 is positioned adjacent sealing surface 132 when aerator device 116 is assembled to spout body 102. Seal 118 is compressed to form a water tight seal between overmold component 120 and aerator device 116. In one embodiment, seal 118 is an o-ring which is positioned proximate an outer periphery edge of aerator device 116 and the sealing surface is a downwardly extending wall. The o-ring is positioned between aerator 116 and the downwardly extending wall of interface 150 when assembled.

Returning to FIG. 1, spout body 102 includes a base portion 137 and a spout portion 139. Base portion 137 includes a passageway 140 which houses the faucet assembly of U.S. patent application Ser. No. 11/700,634, filed Jan. 31, 2007, entitled "FAUCET INCLUDING A MOLDED WATERWAY ASSEMBLY," as mentioned above. Further, spout portion 139 of spout body 102 includes a channel 142 which receives a first portion 143 fluid transport component 104. Channel 142 extends from passageway 140 to a location proximate the discharge end of spout body 102.

Figure 3:
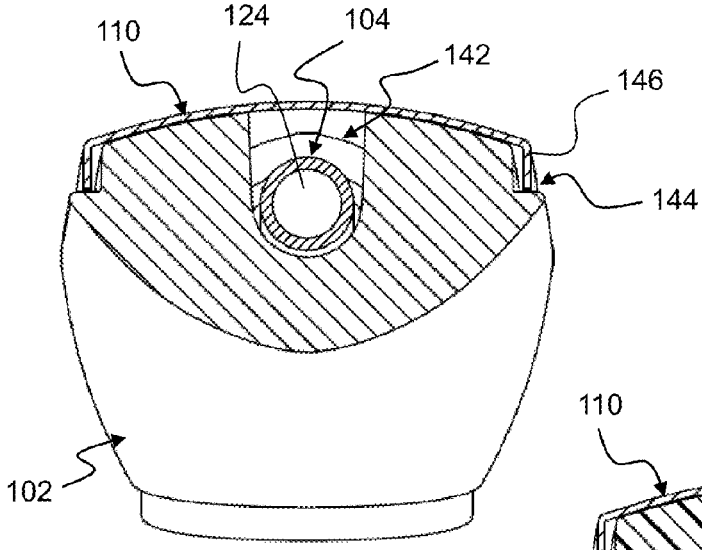
FIG. 3 is a sectional view of the partial spout assembly of FIG. 2 along lines 3-3.
Figure 3A:
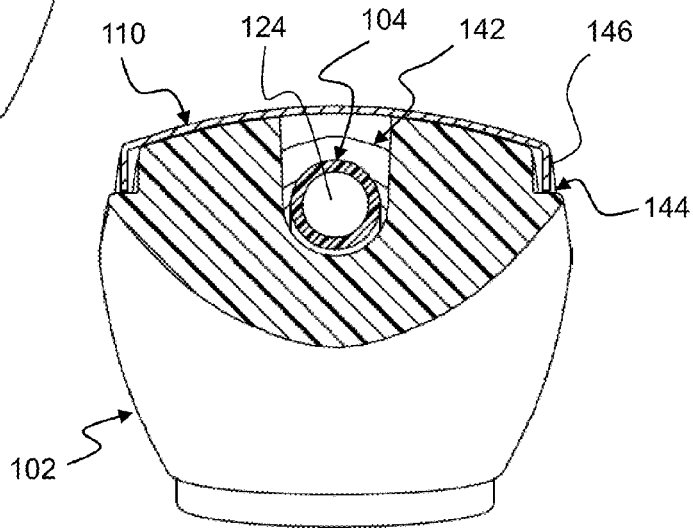
FIG. 3A is the sectional view of FIG. 3, shown with a non-metallic spout body and a non-metallic fluid transport component.
Figure 5:
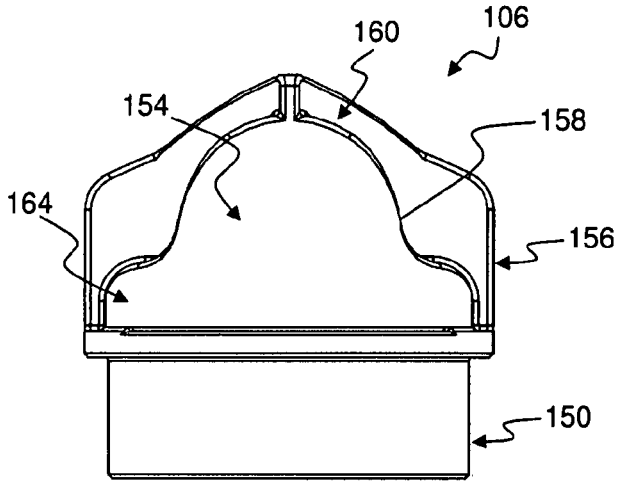
FIG. 5 is a back view of the holder of FIG. 4.
Figure 4:
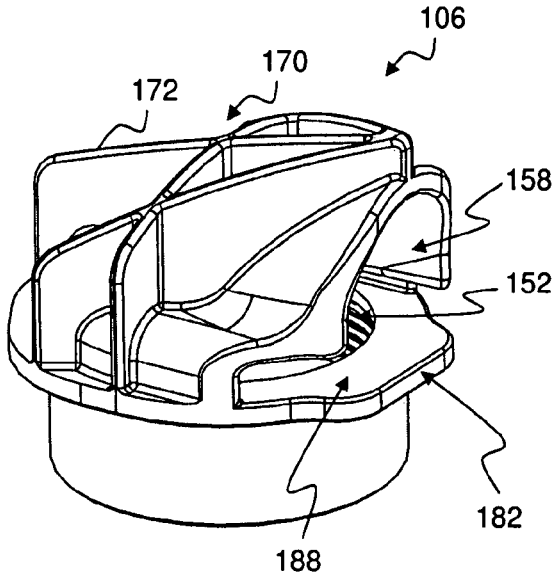
FIG. 4 is a first perspective view of the holder of FIG. 1.

As shown in FIG. 3, fluid transport component 104 rests in channel 142 when spout assembly 100 is assembled. Cover 110 is positioned over channel 142 and conceals channel 142 from the view of an outside observer. A lip 146 on cover 110 is positioned in a recess 144 of spout body 102. Recess 144 is provided around a complete outside perimeter of spout body 102.

Referring to FIGS. 4 through 7, holder 106 is shown. Holder 106 includes a lower portion 150 which includes threads 152 on an inner surface of a fluid conduit 154. Threads 152 threadably couple aerator body 114 to assemble aerator device 116 to the remainder of spout assembly 100. An upper portion 156 of holder 106 includes an opening 158 of fluid conduit 154. Opening 158 is sized to receive overmold component 120. In one embodiment, the shape of fluid conduit 154 and opening 158 generally are chosen to match the shape of overmold component 120. By matching the shape of the overmold component 120 and the opening 158 of holder 106 the movement of overmold component 120 relative to holder 106 is generally constrained except for in direction 194.

Opening 158 includes a generally cylindrical part 160 to receive a cylindrical portion 162 (see FIG. 1) of overmold component 120 and a lower disk shaped portion 164 sized to receive a disk shaped portion 166 of overmold component 120. An outer portion of holder 106 includes a plurality of ribs 170 which provide structural support to holder 106. In one embodiment, the shape of ribs 170 is chosen such that when cover 110 is assembled to spout body 102 an inside surface of cover 110 is positioned generally against a top surface 172 of ribs 170 of holder 106.

Figure 6:
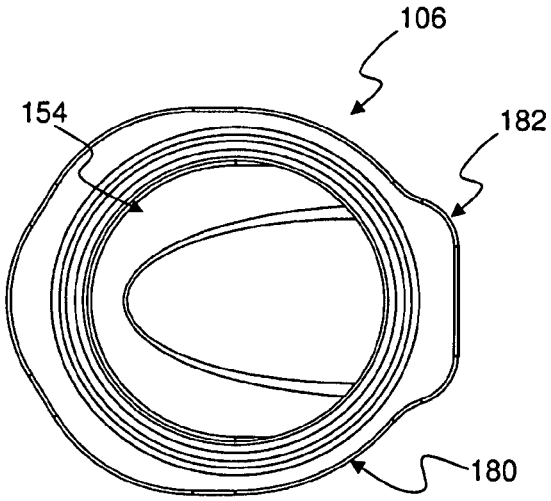
FIG. 6 is a bottom view of the holder of FIG. 4.
Figure 7:
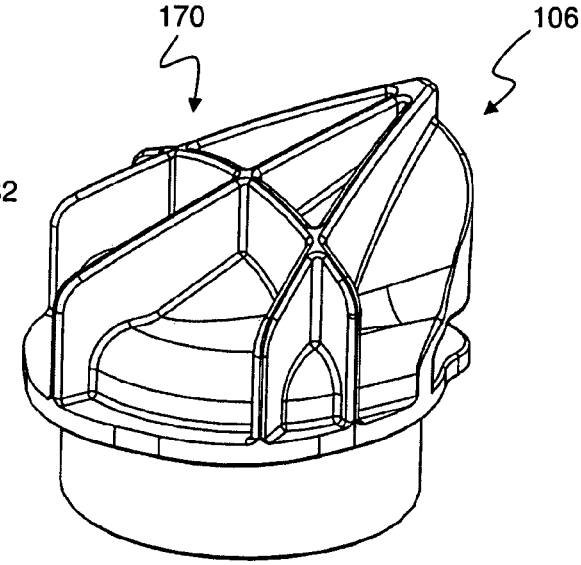
FIG. 7 is a second perspective view of the holder of FIG. 4.
Figure 8:
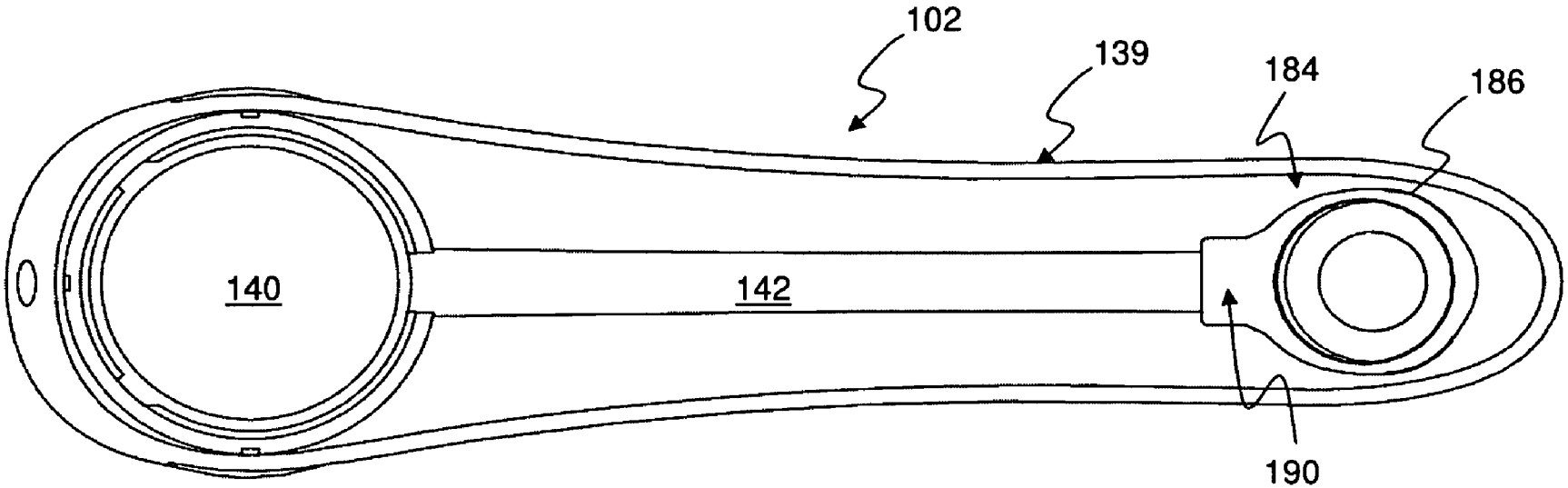
FIG. 8 is a top view of the spout body of the spout assembly of FIG. 1.

As shown in FIG. 6, lower portion 150 of holder 106 has a perimeter 180. Perimeter 180 includes a tab 182 positioned below opening 158 of holder 106. Referring to FIG. 8, an enlarged portion 184 of channel 142 of spout body 102 is sized to correspond with the perimeter 180. A perimeter 186 of enlarged portion 184 of channel 142 is recessed. During assembly lower portion 150 of holder 106 is received in recess 190.

To assemble the spout assembly 100, overmold component 120 is received in opening 158 of holder 106. The assembly of fluid carrying system 101 and holder 106 are positioned in channel 142 such that a ledge 188 of the lower portion 150 which includes perimeter 180 is received in the recess 190 provided in enlarged portion 184 of channel 142.

In order to assemble the combination of the assembly of holder 106 and fluid carrying system 101 with spout body 102, the combination is moved downward in a direction 192. Once ledge 188 of holder 106 is positioned in recess 190, overmold component 120 may not be moved in direction 194 due to the interference with a wall 195 of channel 142. Wall 195 blocks the egress of or retains overmold component within holder 106. As such, end portion 108 of fluid carrying system 101 is held in place through the cooperation of holder 106 and spout body 102. In other words, to remove overmold component 120 from holder 106, holder 106 and fluid carrying system 101 must be translated upward in direction 196 until ledge 188 is no longer received in recess 190.

Once the combination of holder 106 and fluid carrying system 101 is properly positioned in recess 190, cover 110 is assembled to spout body 102. Seal 118 is positioned adjacent to sealing surface 132 of overmold component 120. Aerator device 116 is positioned adjacent to seal 118. Aerator body 114 is threadably received by threads 152 of holder 106. The tightening of aerator body 114 compresses seal 118 and forms a water tight seal between aerator device 116 and sealing surface 132 of overmold component.

In one embodiment, the fluid carrying system 101 is held in place relative to holder 106 snap features provided on one or both of overmold component 120 and holder 106. In one embodiment, the fluid carrying system 101 is held in place relative to holder 106 by clips.

Although the invention has been described in detail with reference to certain preferred embodiments, variations and modifications exist within the spirit and scope of the invention as described and defined in the following claims.

The invention claimed is:

1. A water delivery system in fluid communication with at least one valve, the water delivery system comprising:

a spout member having a discharge end;

an aerator for positioning adjacent the discharge end of the spout member;

a fluid transport member having a fluid conduit with a first end in fluid communication with the at least one valve and a second end positioned proximate the discharge end of the spout member;

a first component coupled to the fluid transport member, the first component including a fluid conduit in fluid communication with the fluid conduit of the fluid transport member and including an interface; and a second component coupled to the aerator and being movable relative to the first component, the second component positioning the first component relative to the aerator, wherein the aerator and the interface of the first component cooperate to form a water tight seal there between.

2. The water delivery system of claim 1, wherein the first component is an overmold component coupled to the fluid transport member.

3. The water delivery system of claim 1, further comprising means for retaining the first component relative to the aerator.

4. The water delivery system of claim 1, wherein the first component is receivable within the second component to position the interface relative to the aerator.

5. The water delivery system of claim 1, wherein the second component includes a passageway having a first portion, the first portion receiving the first component.

6. The water delivery system of claim 5, wherein the spout member includes a channel for receiving the fluid transport member, the channel including an enlarged portion receiving the second component.

7. The water delivery system of claim 6, wherein the first component is held in position relative to the first portion of the passageway of the second component due to a first portion of the spout member blocking an egress of the first component from the first portion of the passageway of the second component.

8. The water delivery system of claim 1, wherein the spout member is made of a non-metallic material.

9. The water delivery system of claim 8, wherein the spout member is made of a thermoset material.

10. The water delivery system of claim 8, wherein the fluid transport member is made of a non-metallic material.

11. The water delivery system of claim 10, wherein the fluid transport member is made of a PEX material.

12. The water delivery system of claim 1, wherein the interface is a sealing surface.

13. The water delivery system of claim 12, wherein the sealing surface is bounded by an inner perimeter.

14. The water delivery system of claim 13, wherein the fluid conduit of the first component further includes a terminal end bounded by the inner perimeter of the inner perimeter.

15. The water delivery system of claim 12, wherein the sealing surface is a flat sealing surface having an outer perimeter, the fluid conduit of the first component having a terminal end positioned within the outer perimeter of the flat sealing surface.

16. The water delivery system of claim 15, wherein the fluid conduit of the first component is angled relative to the flat sealing surface.

17. The water delivery system of claim 15, wherein the second component includes a first set of threads and the aerator includes a second set of threads, the first set of threads and the second set of threads cooperating to couple the aerator to the second component.

18. The water delivery system of claim 17, wherein a seal is positioned between the aerator and the first component, the seal being compressed between the aerator and the flat sealing surface to form the water tight seal when the aerator is coupled to the second component.

19. The water delivery system of claim 18, wherein the seal is an o-ring.

20. A water delivery system in fluid communication with at least one valve, the water delivery system comprising:

a body;

a fluid transport member positioned within the body and adapted to be in fluid communication with the at least one valve, the fluid transport member having a first end through which water exits; an overmold component coupled to the first end of the fluid transport member; and a holder supported by the body and including a fluid conduit having a first end and a second end, the overmold component and the fluid transport member being received in the first end of the holder, wherein the overmold component and the first end of the fluid transport member are held within the fluid conduit of the holder by translating the holder to a first position relative to the body in a first direction and the overmold component and the first end of the fluid transport member are removable from within the fluid conduit of the holder by translating the holder to a second position relative to the body in a second direction, the first end of the fluid conduit of the holder being angled relative to the second end of the fluid conduit of the holder.

21. The water delivery system of claim 20, wherein the body is made of a non-metallic material.

22. The water delivery system of claim 20, wherein the body is made of a thermoset material.

23. The water delivery system of claim 20, wherein the fluid transport member is made of a non-metallic material.

24. The water delivery system of claim 20, wherein the fluid transport member is made of a PEX material.

25. The water delivery system of claim 20, wherein the first direction is opposite the second direction.

26. The water delivery system of claim 20, wherein the body includes a base portion and a spout portion, the spout portion having a channel for receiving a first portion of the fluid transport member, the first portion of the fluid transport member including the first end of the fluid transport member.

27. The water delivery system of claim 26, wherein the channel includes an enlarged portion to receive the holder, the enlarged portion of the channel having a profile which generally matches a profile of the holder.

28. The water delivery system of claim 26, wherein the channel includes an enlarged portion to receive the holder, the enlarged portion of the channel and the holder cooperating to retain the first end of the fluid transport member in the first end of the holder.

29. The water delivery system of claim 28, wherein the overmold component being retained in the first end of the holder through cooperation of the enlarged portion of the channel and the holder.

30. The water delivery system of claim 29, wherein the overmold component includes a fluid conduit having a first portion in fluid communication with the first end of the fluid transport member and a second portion including a terminal in fluid communication with an exterior of the overmold component.

31. A water delivery system in fluid communication with at least one valve, the water delivery system comprising:

a spout including a body having a base portion and a spout portion, the spout being made of a non-metallic material, wherein the spout portion includes a channel extending from the base portion to a location proximate a discharge end of the spout portion;

a fluid transport member having a fluid conduit with a first end in fluid communication with the at least one valve and a second end positioned proximate the discharge end of the spout portion of the body of the spout, a portion of the fluid transport member being received in the channel; and an overmold component coupled to the second end of the fluid transport member, wherein the channel is configured to retain the second end of the fluid transport member proximate the discharge end of the spout portion of the body of the spout, the channel includes an enlarged portion to receive a holder, the enlarged portion of the channel and the holder cooperating to retain the second end of the fluid transport member in a first end of the holder, and the overmold component being retained in the first end of the holder through the cooperation of the enlarged portion of the channel and the holder.

32. The water delivery system of claim 31, wherein the body is made of a thermoset material.

33. The water delivery system of claim 31, wherein the fluid transport member is made of a non-metallic material.

34. The water delivery system of claim 31, wherein the fluid transport member is made of a PEX material.

35. A water delivery system in fluid communication with at least one valve, the water delivery system comprising:

a body;

a fluid transport member positioned within the body and adapted to be in fluid communication with the at least one valve, the fluid transport member having a first end through which water exits;

a holder supported by the body and including a fluid conduit having a first end and a second end, the first end of the fluid transport member being received in the first end of the holder; and an overmold component coupled to the first end of the fluid transport member, wherein the first end of the fluid transport member is held within the fluid conduit of the holder by translating the holder to a first position in a first direction and the first end of the fluid transport member is removable from the within the fluid conduit of the holder by translating the holder to a second position in a second direction, the body includes a base portion and a spout portion, the spout portion having a channel for receiving a first portion of the fluid transport member, the first portion of the fluid transport member including the first end of the fluid transport member, the channel includes an enlarged portion to receive the holder, the enlarged portion of the channel and the holder cooperating to retain the first end of the fluid transport member in the first end of the holder, and the overmold component being retained in the first end of the holder through the cooperation of the enlarged portion of the channel and the holder.

36. The water delivery system of claim 35, wherein the first end of the fluid conduit of the holder is angled relative to the second end of the fluid conduit of the holder.

37. The water delivery system of claim 35, wherein the body is made of a non-metallic material.

38. The water delivery system of claim 35, wherein the body is made of a thermoset material.

39. The water delivery system of claim 35, wherein the fluid transport member is made of a non-metallic material.

40. The water delivery system of claim 35, wherein the fluid transport member is made of a PEX material.

41. A water delivery system in fluid communication with at least one valve, the water delivery system comprising:

a spout member having a discharge end;

an aerator for positioning adjacent the discharge end of the spout member;

a fluid transport member having a fluid conduit with a first end in fluid communication with the at least one valve and a second end positioned proximate the discharge end of the spout member;

a first component coupled to the fluid transport member, the first component including a fluid conduit in fluid communication with the fluid conduit of the fluid transport member and including an interface; and a second component coupled to the aerator, the second component positioning the first component relative to the aerator, wherein the aerator and the interface of the first component cooperate to form a water tight seal there between, the second component includes a passageway having a first portion, the first portion receiving the first component, the spout member includes a channel for receiving the fluid transport member, the channel including an enlarged portion receiving the second component.

42. The water delivery system of claim 41, wherein the first component is held in position relative to the first portion of the passageway of the second component due to a first portion of the spout member blocking an egress of the first component from the first portion of the passageway of the second component.

43. The water delivery system of claim 41, wherein the second component is moveable relative to the first component.

44. The water delivery system of claim 41, wherein the interface is a sealing surface.

45. The water delivery system of claim 44, wherein the sealing surface is a flat sealing surface having an outer perimeter, the fluid conduit of the first component having a terminal end positioned within the outer perimeter of the flat sealing surface.

46. The water delivery system of claim 45, wherein the fluid conduit of the first component is angled relative to the flat sealing surface.

47. The water delivery system of claim 45, wherein the second component includes a first set of threads and the aerator includes a second set of threads, the first set of threads and the second set of threads cooperating to couple the aerator to the second component.

48. The water delivery system of claim 45, wherein a seal is positioned between the aerator and the first component, the seal being compressed between the aerator and the flat sealing surface to form the water tight seal when the aerator is coupled to the second component.

* * * * *